United States Patent [19]

Merritt

[11] 4,082,289

[45] Apr. 4, 1978

[54] HORSERACING GAME

[75] Inventor: Ronald Merritt, Staten Island, N.Y.

[73] Assignee: The Raymond Lee Organization, Inc., New York, N.Y. ; a part interest

[21] Appl. No.: 695,747

[22] Filed: Jun. 14, 1976

[51] Int. Cl.[2] ..... A63F 3/00

[52] U.S. Cl. ..... 273/246

[58] Field of Search ..... 273/134

[56] References Cited

U.S. PATENT DOCUMENTS

| | | | |
|---|---|---|---|
| 1,797,742 | 3/1931 | Ward | 273/134 AG |
| 2,036,630 | 4/1936 | Hastings | 273/134 CH |
| 3,462,151 | 8/1969 | Parisi | 273/134 CH |
| 3,963,243 | 6/1976 | Contento | 273/134 CH |

FOREIGN PATENT DOCUMENTS

| | | | |
|---|---|---|---|
| 1,551,243 | 11/1968 | France | 273/134 CH |
| 601,945 | 5/1948 | United Kingdom | 273/134 CB |

*Primary Examiner*—Richard C. Pinkham
*Assistant Examiner*—Harry G. Strappello
*Attorney, Agent, or Firm*—Daniel Jay Tick

[57] ABSTRACT

A square gameboard has four corner squares marked at the four corners thereof and 36 boxes marked along the four edges thereof, nine boxes being marked along each edge between the corner squares thereof and a race track at the center of the gameboard. A plurality of markers are shaped as miniature horses, each being of a different color. A plurality of chips are provided of the same number and colors as the markers. A plurality of post position cards are provided. A plurality of dice of the same number and colors as the markers are provided. A pair of throwing dice, a plurality of odds chips, play money and a dice cup are also provided.

1 Claim, 10 Drawing Figures

HORSERACING GAME

BACKGROUND OF THE INVENTION

The present invention relates to a horseracing game. Objects of the invention are to provide a horseracing game which is easy to play and provides considerable amusement, enjoyment, interest and education to participants and onlookers.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
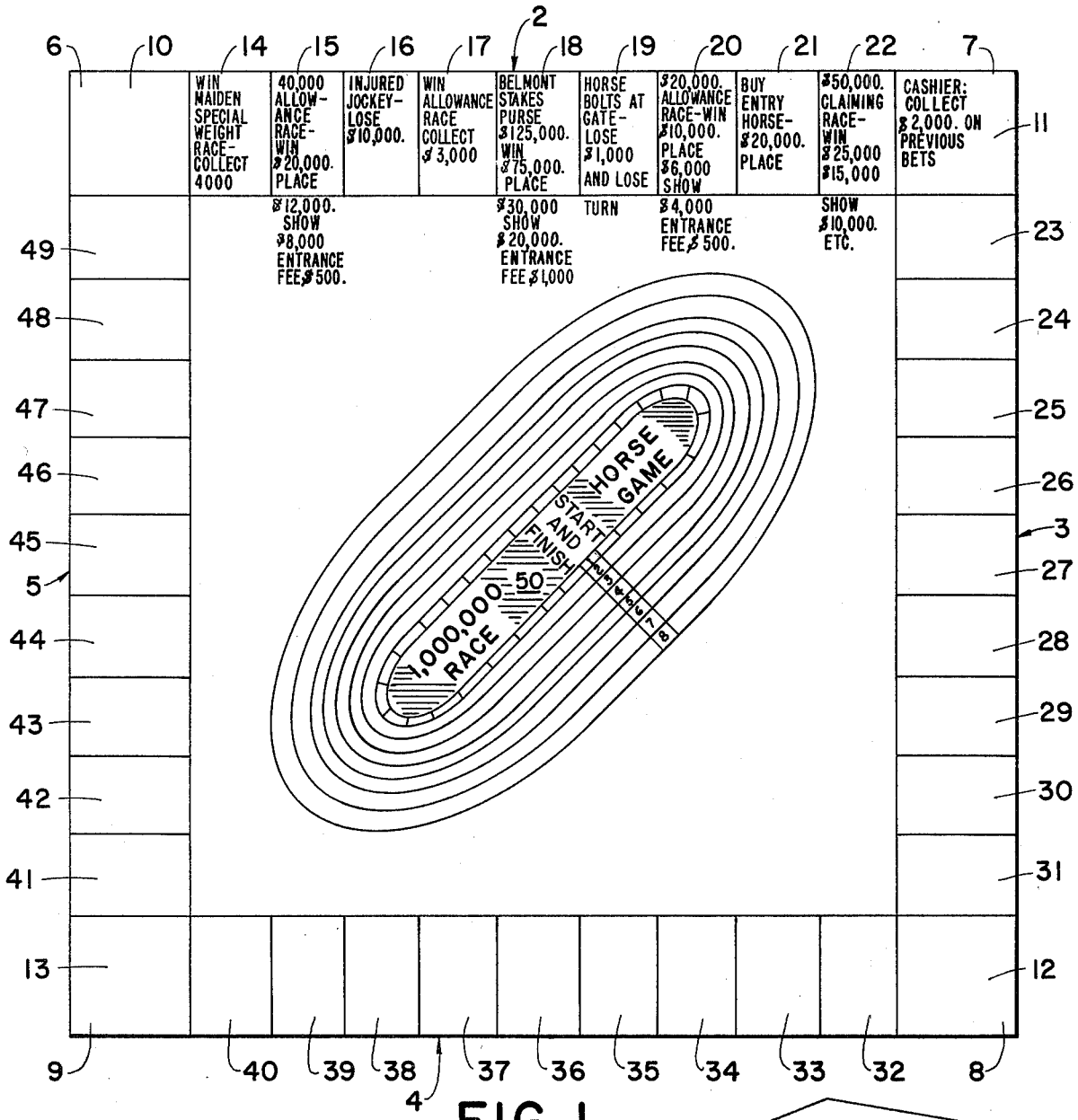
FIG. 1 is a plan view of an embodiment of the gameboard of the horseracing game of the invention.

The horseracing game of the invention comprises a square gameboard 1, as shown in FIG. 1, having four edges 2, 3, 4 and 5, four corners 6, 7, 8 and 9, four corner squares 10, 11, 12 and 13 marked at the four corners 6 to 9, respectively, of the board, and 36 boxes, 14 to 49, marked along the edges 2 to 5, respectively, nine boxes being marked along each edge between the corner squares thereof.

Each of the three corner squares 10, 12 and 13 is marked "WINNERS OF KENTUCKY DERBY, PREAKNESS AND BELMONT STAKES COLLECT $500,000. FOR STUD OR COLLECT $250,000. FOR WINNING ANY TWO OF THESE RACES". The square 11 is marked "CASHIER: COLLECT $2,000. ON PREVIOUS BETS". The boxes 14 to 22 are marked in the following manner. "WIN MAIDEN SPECIAL WEIGHT RACE — COLLECT 4000", "40,000 ALLOWANCE RACE — WIN $20,000., PLACE $12,000., SHOW $8,000., ENTRANCE FEE $500.", "INJURED JOCKEY — LOSE 10,000.", "WIN — ALLOWANCE RACE — COLLECT 3,000.", "BELMONT STAKES PURSE $125,000., WIN $75,000., PLACE $30,000., SHOW $20,000., ENTRANCE FEE $1,000.", "HORSE BOLTS AT GATE — LOSE $1000. AND LOSE TURN", "20,000. ALLOWANCE RACE — WIN $10,000., PLACE $6,000., SHOW $4,000., ENTRANCE FEE $500.", "BUY ENTRY HORSE — $20,000."and $50,000. CLAIMING RACE — WIN $25,000., PLACE $15,000., SHOW $10,000., ENTRANCE FEE $500., CLAIMING PRICE $55,000.".

The boxes 23 to 31 are marked in the following manner. "BUY NEW BARN — $20,000.", "$20,000. CLAIMING RACE — WIN $10,000., PLACE $6,000., SHOW $4,000., ENTRANCE FEE $500., CLAIMING PRICE $20,000.", "WIN CLAIMING RACE — COLLECT $3,000.", "WIN MAIDEN SPECIAL WEIGHT RACE — COLLECT $5,000.", "$60,000. ADDED HANDICAP — WIN $35,000., PLACE $15,000., SHOW $10,000., ENTRANCE FEE $1,000.", "JOCKEY FALLS OFF HORSE — LOSE $1,000.", "$15,000. CLAIMING RACE — WIN $9,000., PLACE $4,500., SHOW $1,500., ENTRANCE FEE $500., CLAIMING PRICE $20,000.", "WIN ALLOWANCE RACE — COLLECT $5,000." and "HORSE HURT IN WORKOUT — LOSE TURN".

The boxes 32 to 40 are marked as follows. "LOSE ENTRY HORSE — BROKEN LEG", "$15,000. STEEPLECHASE WIN $8,000., PLACE $4,000., SHOW $3,000., ENTRANCE FEE $500.", "FIRE DESTROYS BARN — COST $40,000.", "WIN MAIDEN SPECIAL WEIGHT RACE — COLLECT $3,000.", "KENTUCKY DERBY — PURSE $75,000., WIN $45,000., PLACE $20,000., SHOW $10,000., ENTRANCE FEE $1000.", "BUY ENTRY HORSE — $20,000.", $50,000. CLAIMING RACE — WIN $30,000., PLACE $15,000., SHOW $5,000., ENTRANCE FEE $500., CLAIMING PRICE $60,000.," FINED FOR FIXING RACES — $10,000." and "WIN ALLOWANCE RACE — $5,000.".

The boxes 41 to 49 are marked as follows. "WIN ALLOWANCE RACE — COLLECT $2,500.", "$30,000. ALLOWANCE RACE — WIN $18,000., PLACE $8,000., SHOW $4,000., ENTRANCE FEE $500.", "HORSE BREAKS LEG — COST $100,000.", "HORSE OF THE YEAR AWARD — COLLECT $15,000.", "PREAKNESS PURSE $100,000., WIN $60,000., PLACE - $25,000., SHOW $15,000., ENTRANCE FEE $1000.", "HORSE DOPED — FINED $15,000.", "WIN CLAIMING RACE — COLLECT $5,000.", "$50,000. ADDED HANDICAP — WIN $30,000., PLACE $15,000., SHOW $5,000., ENTRANCE FEE $500." and "WIN MATCH RACE —COLLECT $10,000".

Figure 2:
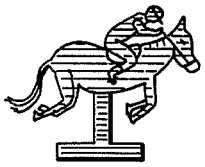
FIG. 2 is a view of a marker of the horseracing game of the invention.

The horseracing game of the invention includes twelve markers shaped as miniature horses. Each pair of the markers is of a color different from the others. A miniature horse marker is shown in FIG. 2. One horse of each color is the player's original horse. The other horse of the same color is an entry horse and has an "E" on its side.

Figure 3:
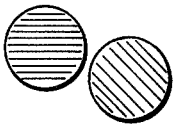
FIG. 3 is a view of a pair of chips of the game of the invention.

The horseracing game of the invention includes six chips of the same colors as the pairs of markers. Two of the chips are shown in FIG. 3.

Figure 4:
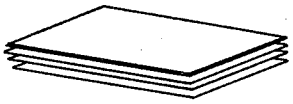
FIG. 4 is a view of some of the post position cards of the horseracing game of the invention.
Figure 5:
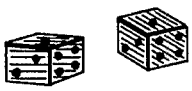
FIG. 5 is a view of a pair of the colored dice of the horseracing game of the invention.
Figure 10:
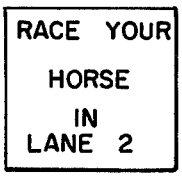
FIG. 10 illustrates an exemplary post position card.
Figure 6:
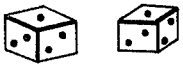
FIG. 6 is a view of the throwing dice of the horseracing game of the invention.
Figure 7:
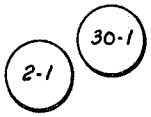
FIG. 7 is a view of two of the odds chips of the horseracing game of the invention.
Figure 8:
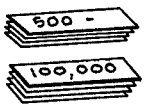
FIG. 8 is a view of some of the play money of the horseracing game of the invention.
Figure 9:
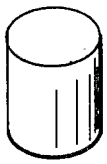
FIG. 9 is a view of the dice cup of the horseracing game of the invention.

Additional items included in the horseracing game of the invention are seven post position cards, shown in FIG. 4. Six dice of the same colors as the markers and chips are included, as shown in FIG. 5. A pair of throwing dice, as shown in FIG. 6, are also included. A plurality of odds chips, included in the game of the invention are marked from 2-1 to 30-1, as shown in FIG. 7. A dice cup (FIG. 9) is utilized to shake and throw the dice of FIG. 6. Play money, as shown in FIG. 8, is provided in denominations of $500 to $100,000.

A race track is provided at the center of the gameboard. The horses race around this track. The track has 8 lanes, each having a different number of spaces. Thus, for example, lane 1 or post position 1 has 21 spaces, lanes 2 and 3 each have 23 spaces, lanes 4 and 5 each have 24 spaces and lanes 6, 7 and 8 each have 25 spaces.

The game of the invention is played by 2 to 6 players. At the start of the game, each player is provided with a marker, a place chip and $50,000. The place chip, as shown in FIG. 3, is the same color as the player's marker and is utilized to hold the horse's place on the gameboard while he races. When a player passes the cashier box 11 he or she receives $2000.

The colored chips are used to keep the places of the players on the gameboard while the players race their horses on the race track. Each player has his or her own color. The place chips correspond to the color of each player's horse. This reminds a player of his position on the outer gameboard track when play resumes.

If a player becomes bankrupt, he returns to the cashier box 11 and receives $50,000 and starts over again. He then loses any entry horse and any wins of the three big races.

If a player's horse wins the Kentucky Derby, the Preakness and the Belmont Stakes, he may sell his horse for stud for the amount of $500,000. He must land on one of the three stud boxes 10, 12 and 13 after all three races are won in order to win the money. Furthermore, he must have accumulated at least $500,000 before selling his horse for stud. If he meets these requirements, he wins the game. If he has an entry horse, he may sell the Triple Crown winner for stud. If a player does not have $500,000 at such time, he must play until he acquires such a sum and he must then land in a stud box 10, 12 or 13. If the player has an entry, but not $500,000, he may sell the entry horse for stud, since he still has one horse left to play.

Entry horses may be purchased when the player lands on an entry horse box 21 or 37. He may then purchase a horse for $20,000. The second horse may race in all the races, thus giving the player a better chance to win money. When the player races his two horse entry, both horses go off at the same odds. A player may own only one entry horse.

A player may not own more than two horses at a time. Each player may own an entry horse, as acquired by the rules of the game. Only two entries may run in each race. The player does not start the game with an entry horse, but must land in an entry horse box and purchase one from the bank or acquire it by using a horse purchased in a claiming race, as described herein. If a player has an entry horse, he must remember which horse wins the Kentucky Derby, the Preakness and the Belmont Stakes. The same horse must win all three races in order to qualify for stud.

If, after winning a race, a horse lands on the shaded area next to the track, he is disqualified and placed last. The next horse to cross the finish line is the winner even if he also lands in the shaded area. This rule applies only to the first horse crossing the finish line. If two horses pass the finish line together and land in the shaded area 50, both are disqualified.

The object of the game is to win one million dollars before anyone else does. As the players move around the gameboard, they win and lose money in accordance with the boxes they land on in accordance with throws of the dice, shown in FIG. 6. When a player lands in a box such as "20,000 ALLOW", all the players race their horses around the track. The player who lands in the box gets the inside post position. All the other players draw their post positions from the seven post position cards. When this has been done, all the players draw odds for their horses from the odds chips.

The horses are lined up behind the starting line and the colored dice are thrown together. The horses then move the number of boxes indicated by the corresponding colored dice. The number of horses racing depends upon the number of players. The first three horses over the finish line collect money in the ratio of win, place and show. Thus, for example, in a $20,000 race, the winning horse wins $10,000, the horse which places wins $6000 and the horse which shows wins $4000. All the money is paid by the bank. Upon entering a race, each player pays an entry fee of $500 to $1000. The players may bet from $500 to $10,000 on any horse or any number of horses in a race. If a horse that the player bets on wins, the player collects the amount of money equivalent to the odds on that horse. Thus, for example, if a player bets $2000 on a 10-1 horse, and the horse wins, the player wins $20,000. All bets and entry fees are paid to the bank.

If two horses cross the finish line on the same throw of the dice, the horse which travels the farthest is the winner, providing he does not land in the shaded area. If two horses cross the finish line on the same throw of the dice and land in the same box, the result is a dead heat and both horses are winners. Bets are then paid on both horses. No bets are paid on disqualifications. The disqualification box is the fifth box after the finish line. The number of boxes a horse must traverse around the track varies with his post position, since the inside track or lane 1 is shorter than the outside track or lane 8. Post position 1 has 21 boxes. Post positions 2 and 3 have 23 boxes. Post positions 4 and 5 have 24 boxes. Post positions 6, 7 and 8 have 25 boxes. Thus, since a horse running in the eighth post position must cover four more boxes than a horse running in the first post position, the player who lands in the 20,000 allow box has an advantage.

The winning horse of a claiming race may be claimed by any player, if he owns only one horse, for the stated claiming price in the box. If more than one player wishes to claim the winner, the players commence bidding for the winner at the claiming price. If no extra horses are available from the bank, however, no horses may be claimed. Claimed horses may run as entries.

If more than two players own entry horses and wish to run them in a specific race, each of the players throws the pair of throwing dice to see which two players may enter their horses. The two highest numbers on the dice win.

A player who loses his horse in a claimer race may purchase another horse for $20,000. This applies only if the players have no other horses.

Players stay with their original color horses throughout the game. Thus, for a first example, if a red horse wins a claiming race and is claimed by a player with a blue horse to be used as his entry horse, the player with the blue horse uses his blue entry horse in all future races. The player who loses his horse repurchases his original red horse for $20,000.

In a second example, if a player running an entry wins a claiming race and the winner is claimed, that horse if removed from the board. The purchaser may then use the entry horse which corresponds with the color of his original in all future races.

If a horse which wins the Kentucky Derby, the Preakness or the Belmont Stakes is claimed, he loses the "win " status of these races. He must then win these races again for his new owner to be eligible for stud.

Since the winner of any of the three big races may be claimed if he wins a claiming race, the owner may race his other horse, if he has one, instead. He need not race an entry. If a player has only one horse, he has no choice, he must run in all races. If all the players have entry horses, no horse may be claimed.

If a player's horse wins the Kentucky Derby, the Preakness and the Belmont Stakes, he may sell his horse for stud for $500,000. If a player's horse wins any two of these three races, he may sell his horse for stud for $250,000. If a player wishes to do this, he must have $750,000 in cash or an entry horse in compliance with the stud rules. A player must remember which of his horses wins two or three of these races.

If a player bets on an entry, whether it is his or not, and either of the horses wins, he collects on his bet.

If both of a player's entry horses come in first, second or third, the player collects the corresponding money of win, show or place on both horses.

A post position card drawn by a player indicates which lane of the race track his horse will race in. Thus, for example, post position card 2 indicates that a player must race his horse in lane 2. These cards thus determine who has the advantage in the race.

The colored dice are thrown to indicate how many spaces around the race track are to be traveled by each horse. The colored dice are both thrown from the cup at the same time. The players move their horses around the race track as many spaces as indicated on the colored dice. The dice correspond in color to the player's horse.

The throwing dice determine the player's movement around the gameboard.

While the invention has been described by means of a specific example and in a specific embodiment, I do not wish to be limited thereto, for obvious modifications will occur to those skilled in the art without departing from the spirit and scope of the invention.

I claim:

1. A horseracing game, comprising a square gameboard having four edges, four corners, four corner squares marked at the four corners thereof and 36 boxes marked along the edges, nine boxes being marked along each edge between the corner squares thereof and a race track at the center of the gameboard, said race track having a plurality of lanes having different numbers of spaces and the boxes on the gameboard containing indicia controlling the game played on the race track;

a plurality of markers shaped as miniature horses each being of a different color;

a plurality of chips of the same number and colors as the markers for keeping the places of the players in the boxes on the gameboard;

a plurality of post position cards for indicating different post positions to be assumed by players selecting them;

a plurality of dice of the same number and colors as the markers for determining the progress of the players' horses around the race track;

a pair of throwing dice for determining the movement of the players around the boxes of the gameboard;

a plurality of odds chips;

play money; and a dice cup.

* * * * *